US005606816A

United States Patent [19]

Schwartz

[11] Patent Number: 5,606,816

[45] Date of Patent: Mar. 4, 1997

[54] MOBILE OF MODULAR CONSTRUCTION FOR DISPLAYING PICTURES

[75] Inventor: Richard Schwartz, Mutton Town, N.Y.

[73] Assignee: North American Enclosures Inc., Central Islip, N.Y.

[21] Appl. No.: 431,856

[22] Filed: May 1, 1995

[51] Int. Cl.[6] ..... G09F 7/22

[52] U.S. Cl. ..... 40/617; 40/775; 40/605; 403/383

[58] Field of Search ..... 40/617, 152, 152.1, 40/159, 605, 611; 446/227; 403/383; 248/328, 290, 159

[56] References Cited

U.S. PATENT DOCUMENTS

| | | | |
|---|---|---|---|
| 2,166,533 | 7/1939 | Oettel | 248/290.1 X |
| 2,994,156 | 8/1961 | Steiner et al. | 446/227 |
| 4,510,189 | 4/1985 | Girard | 40/617 X |
| 4,567,682 | 2/1986 | Hurxthal | 40/617 |

FOREIGN PATENT DOCUMENTS

| | | | |
|---|---|---|---|
| 1249214 | 11/1960 | France | 40/617 |
| 2746628 | 4/1979 | Germany | 40/617 |

*Primary Examiner*—Kenneth J. Dorner
*Assistant Examiner*—Cassandra Davis
*Attorney, Agent, or Firm*—Howard C. Miskin

[57] ABSTRACT

A mobile that is constructed from modular components. The mobile is particularly suited for displaying pictures (i.e. photographs) and updating pictures from time to time. The modular components include display envelopes, a modular support, a hanger, and a suspension medium (i.e. thread). Each of the display envelopes are capable of simultaneously displaying two pictures. The display envelopes are suspended from the modular support via the suspension medium. The hanger is centrally located along the length of the modular support and facilitates hanging the modular support and the associated display envelopes from an external structure. The modular support and interconnected display envelopes are optimally balanced by the alignment of the hanger. In particular, the modular support and the associated display envelopes are balanced by longitudinally sliding the hanger along the modular support.

8 Claims, 3 Drawing Sheets

MOBILE OF MODULAR CONSTRUCTION FOR DISPLAYING PICTURES

FIELD OF THE INVENTION

The present invention relates generally to a mobile, and more particularly to a mobile constructed from modular components which are suitable for displaying artwork, pictures, or photographs.

BACKGROUND ART

Background art mobiles typically include various suspended ornamental elements that have permanent geometric shapes or that depict a particular subject matter. If the mobile is mounted in a room in which the decor is periodically changed, an entirely new mobile must often be purchased to properly coincide the new theme of the room. Moreover, even if the decor of the room remains static, the user of the mobile may tire of the particular subject matter depicted by the mobile. Therefore, there is a need for a mobile which permits a user to easily alter the subject matter depicted by the mobile.

Background art mobiles are frequently constructed from components having different geometrical configurations. If the background art mobile is made from plastic, an additional process may be required to mold each different component. As a result, the additional process may increase manufacturing costs of some of the background art mobiles. Therefore, there is a need for a mobile which reuses identical components throughout the mobile.

SUMMARY OF THE INVENTION

The present invention relates to a mobile that is constructed from modular components. The mobile is particularly suited for displaying pictures (i.e. photographs) and updating pictures from time to time. The modular components include display envelopes, a modular support, a hanger, and a suspension medium (i.e. thread). Each of the display envelopes are capable of simultaneously displaying two pictures. The display envelopes are suspended from the modular support via the suspension medium. The hanger is centrally located along the length of the modular support and facilitates hanging the modular support and the associated display envelopes from an external structure. The modular support and interconnected display envelopes are optimally balanced by the alignment of the hanger. In particular, the modular support and the associated display envelopes are balanced by longitudinally sliding the hanger along the modular support.

In a preferred embodiment the mobile includes modular assemblies and an intermediate support which are coupled by suspension media. In particular, the modular assemblies include a first modular assembly, a second modular assembly, and a third modular assembly. Each modular assembly includes display envelopes, a modular support, and a hanger. The display envelopes are suspended from the modular support. Each modular assembly is interconnected to the mobile by its hanger. The intermediate support is preferably constructed from two modular supports placed end to end and joined by a coupler. The suspension media, namely, the primary suspension medium and the secondary suspension medium, comprises thread, wire, filament line, polymer line, or the like.

The modular assemblies are interconnected as follows. The first modular assembly is, for example, suspended from an optional arm assembly via the primary suspension medium. The first modular assembly is coupled to the intermediate support via the primary suspension media. The second modular assembly and the third modular assembly are suspended from the intermediate support, and the first modular assembly, via the suspension media. The primary suspension medium, which extends to the intermediate support, is oriented on an upper member of the coupler to balance the weight distribution of the first modular assembly and the second modular assembly.

DETAILED DESCRIPTION

Figure 1:
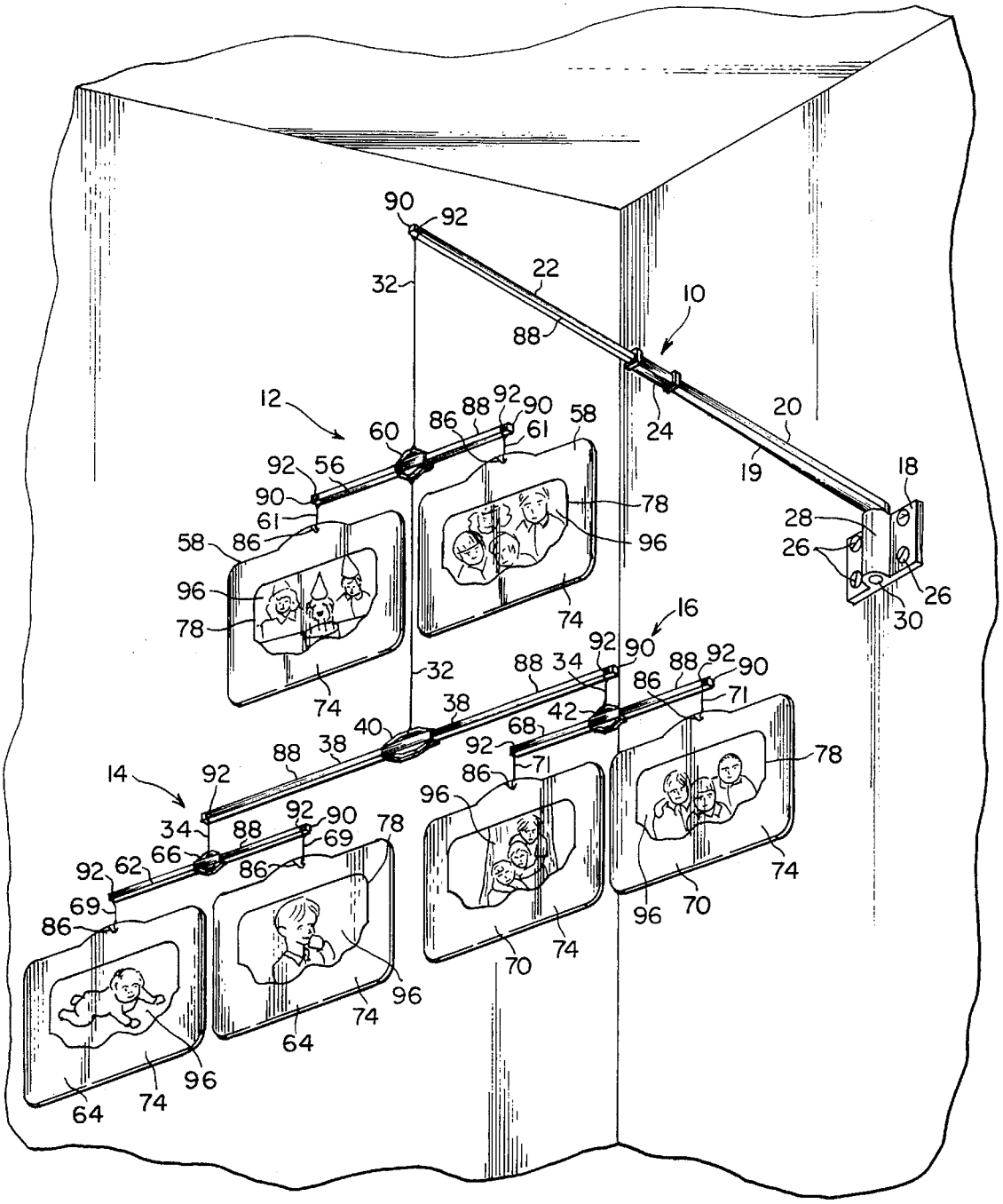
FIG. 1 is a perspective view of the fully assembled mobile wherein the mobile is supported by an arm assembly which is pivotally mounted on a wall by a bracket.

The present invention is directed toward a mobile that is constructed from modular components. A modular component is a structural element with a standard size, shape, or configuration. The modular components include a display envelope, a modular support, and a hanger. An arrangement of the modular components may be referred to as a modular assembly. FIG. 1 shows a perspective view of a preferred embodiment of the mobile that includes modular supports, hangers, and display envelopes. FIG. 2 through FIG. 8, inclusive, depict the details of various components of the preferred embodiment shown in FIG. 1.

Referring to FIG. 1, a preferred embodiment of the mobile comprises a first modular assembly 12, a second modular assembly 14, a third modular assembly 16, an intermediate support 38, a primary suspension media 32, and a secondary suspension media 34. In addition, the preferred embodiment of the mobile may also include, but need not include, an arm assembly 10. The first modular assembly 12 is, for example, suspended from the arm assembly 10 or an external structure via the primary suspension medium 32. The first modular assembly 12 is coupled to the intermediate support 38 via the primary suspension medium 32. The second modular assembly 14 and the third modular assembly 16 are suspended from the intermediate support 38 via the secondary suspension media 34.

The first modular assembly 12, the second modular assembly 14, and the third modular assembly 16, each include display envelopes, a modular support 88, and a hanger 42. The hanger 42 is centrally located on each modular support 88. The display envelopes 73 are suspended from each modular support 88 by suspension media or means for suspending display envelopes. Pictures 96, photographs, or artwork are optimally mounted in each display envelope. Each of said modular assemblies may be hung from its hanger 42 and balanced by alignment of its hanger 42.

The first modular assembly 12 is coupled to the intermediate support 38 via the primary suspension medium 32. The primary suspension medium 32 extends between a hanger 42 associated with the first modular assembly 12 and a coupler 40 associated with the intermediate support 38. The intermediate support 38 is preferably constructed from two modular supports 88 placed end to end and coupled by the coupler 40. The orientation of the primary suspension medium 32 on the coupler 40 is optimized to balance the second modular assembly 14 and the third modular assembly 16. The second modular assembly 14 and the third modular assembly 16 are suspended from the intermediate support 38 by the secondary suspension medium 34.

The arm assembly 10 optimally comprises a bracket 18, a pivot arm 20, a union 24, and an extension arm 22. The bracket 18 may be mounted to an external structure, such as wall, by fasteners 26. The pivot arm 20 is pivotally coupled to the bracket 18. The pivot arm 20 is joined to the extension arm 22 at the union 24. The extension arm 22 preferably comprises a modular support 88. The extension arm 22 is coupled to the first modular assembly 12 via the primary suspension medium 32.

As used herein, the prefixal adjectives "first" "second", and "third" are placed before each modular component to indicate the association of a display envelope, a modular support 88, or a hanger 42 with a particular modular assembly.

First Modular Assembly

For example, the first modular assembly 12 comprises a first modular support 56, first display envelopes 58, first suspension means for suspending a display envelope 64, and a first hanger 60 as illustrated in FIG. 1. The first display envelopes 58 are suspended from the first modular support 56 via the first suspension means 61. The first hanger 60 frictionally engages the first modular support 56. The first modular assembly 12 is interconnected to the mobile via the first hanger 60.

The first modular support 56 preferably comprises a substantially rectangular beam. The first modular support 56 has a support cross section and support ends 90. Support apertures 92 are optimally located at or near each support end 90.

Figure 2:
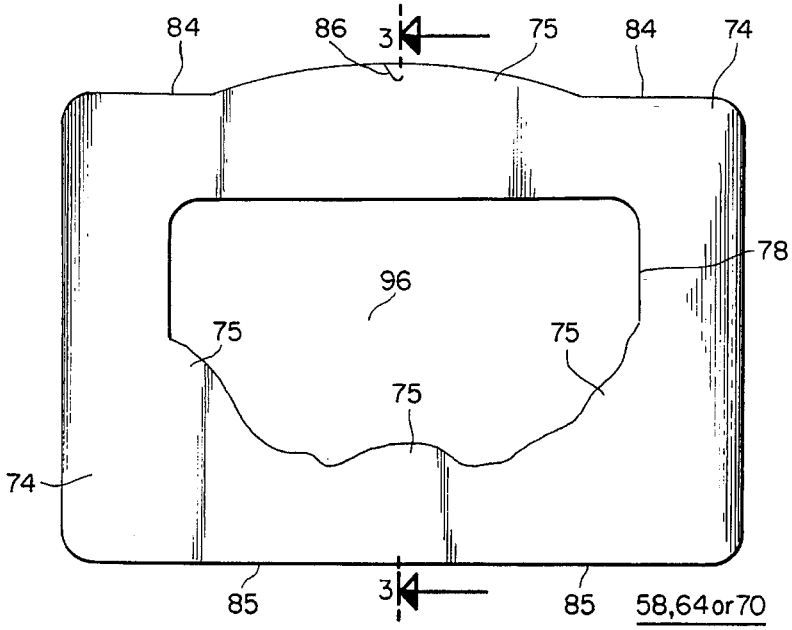
FIG. 2 is an elevation view of the front frame of a display envelope.
Figure 3:
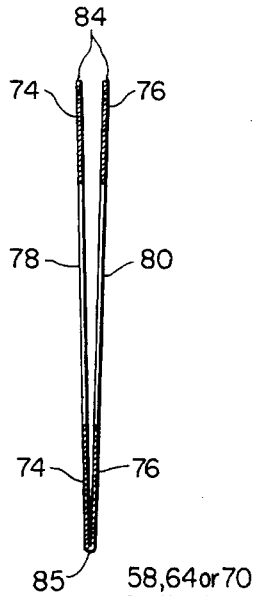
FIG. 3 is a cross-sectional view of the display envelope in FIG. 2 as viewed along reference line 3—3.

Referring to FIG. 1 through FIG. 3, inclusive, each first display envelope 58 has a front frame 74 and a rear frame 76 for displaying pictures 96, artwork, or photographs. The front frame 74 is hinged or flexibly attached to the rear frame 76 near an envelope bottom 85 of the first display envelope 58. Each first display envelope 58 has a front window 78 with a front window area and a rear window 80 with a rear window area. Each window area is optimally equal to or smaller than the area of a picture 96 or a commercially available photograph, which is placed into the first display envelope 58. A curved groove 86 is located near or at an envelope top 84 of each first display envelope 58. The curved groove 86 preferably comprises a channel or an incision having a check-mark shape.

The first suspension means 61 may comprise a plastic line, polymer line, fishing line, filament line, thread, wire, rope, twine, string, yarn, chain, or the like. The first suspension means 61 is fed through the support apertures 92 of the first modular support 56. In addition, the first suspension means 61 is routed or laced through the curved groove 86 to couple the first display envelopes 58 to the first modular support 56. The first suspension means 61 may be tied into various knots, for example, slip knots, figure-eight knots, clove hitch knots, hitch knots, square knots, or the like. The knots are aligned to secure the first modular support 56 to the first display envelopes 58.

Figure 4:
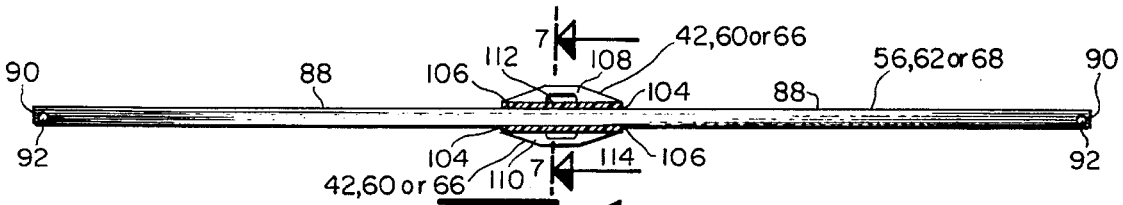
FIG. 4 is an elevation view a modular support and an associated hanger, which is positioned centrally along the length of the modular support; the hanger is cut away to reveal a longitudinal cross section of the hanger.
Figure 7:
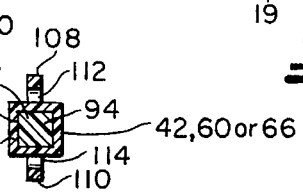
FIG. 7 is a transverse cross sectional view of the hanger as viewed along reference line 7—7 of FIG. 4.

Referring to FIG. 1, FIG. 4, and FIG. 7, a first hanger 60 frictionally engages a portion of the support cross section 94 of the first modular support 56. The first hanger 60 is centrally located along the length of the first modular support 56. The first hanger 60 has a main segment 106, an upper segment 108, and a lower segment 110. The main segment 106 has a longitudinal passageway 104 therethrough, preferably having a cross section that substantially conform to the support cross section 94 of the first modular support 56. A clearance between the boundaries of the passageway 104 and the support cross section 94 of the first modular support 56 permits the first hanger 60 to be frictionally slid along the length of the first modular support 56 to balance the first modular assembly 12. Balancing refers balancing the distribution of the weight of the first modular assembly 12 by making the first modular support 56 substantially horizontal when the mobile of the present invention is suspended from any structure.

Second Modular Assembly

The second modular assembly 14 comprises a second modular support 62, second display envelopes 64, the second suspension means for suspending a display envelope 69, and a second hanger 66. The second display envelopes 64 are suspended from the second modular support 62 via the second suspension means 69. The second hanger 66 frictionally engages the second modular support 62. The second modular assembly 14 is interconnected to the mobile via the first hanger 60.

The second modular support 62 preferably comprises a substantially rectangular beam as illustrated in FIG. 1. The second modular support 62 has a support ends 90. Support mounting apertures 92 are located at or near each support end 90.

Referring to FIG. 1 through FIG. 3, inclusive, each second display envelope 64 has the same elements as that of the first display envelope 58 and is alternatively indicated therein. More particularly, each second display envelope 64 has a front frame 74 and a rear frame 76 for displaying pictures 96, artwork, or photographs. The front frame 74 is hinged or flexibly attached to the rear frame 76 near an envelope bottom 85 of the second display envelope 64. Each second display envelope 64 has a front window 78 with a front window area. The front window area is optimally equal to or smaller than the area of a commercially available photograph or picture 96, which is mounted in the front frame 74. A curved groove 86 is located near or at the envelope top 84 of each second display envelope 64. The curved groove 86 preferably comprises an incision or a channel having a check-mark shape.

The second suspension means 69 may comprise a plastic line, polymer line, fishing line, filament line, thread, wire, rope, twine, string, yarn, chain, or the like. The second suspension means 69 is fed through the support apertures 92 of the second modular support 62. The second suspension means 69 is routed or laced through the curved groove 86 to couple the second display envelope 64 to the second modular support 62. The second suspension means 69 may be tied into various knots, for example, slip knots, figure-eight knots, clove hitch knots, hitch knots, square knots, or the like. The knots are aligned to secure the second modular support 62 to the second display envelopes 64.

Referring to FIG. 1, FIG. 4, and FIG. 7, a second hanger 66 and a second modular support 62 have many of the same illustrated features as those of the first hanger 60 and the first modular support 56, respectively, and is respectively and alternatively indicated therein. More particularly, the second hanger 66 frictionally engages a portion of the support cross section 94 of the second modular support 62. The second hanger 66 has a main segment 106, an upper segment 108, and a lower segment 110 as illustrated in FIG. 4. The main segment 106 has a longitudinal passageway 104 therethrough with a cross section which substantially conform to the support cross section 94 of the second modular support 62. A clearance between the passageway 104 and the support cross section 94 of the second modular support 62 permits the second hanger 66 to be slid along the length of the second modular support 62 to balance the second modular assembly 14.

Third Modular Assembly

The third modular assembly 16 comprises a third modular support 68, third display envelopes 70, the third suspension means for suspending display envelopes 71, secondary suspension media 34, and a third hanger 72. The third modular support 68 preferably comprises a substantially rectangular beam as illustrated in FIG. 1. The third modular support 68 has a support ends 90. Support apertures 92 are located at or near each support end 90.

Referring to FIG. 1 through FIG. 3, inclusive, each third display envelope 70 has the same elements as those of the first and second display envelopes 58 and 64, respectively, and is alternatively indicated therein. More particularly, each third display envelope 70 has a front frame 74 and a rear frame 76 for displaying pictures 96, artwork, or photographs. The front frame 74 is hinged or flexibly attached to the rear frame 76 near an envelope bottom 85 of the third display envelope 70. Each third display envelope 70 has a front window 78 with a front window area. The front window area is optimally equal to or smaller than the area of a commercially available photograph or picture 96, which is placed in the front frame 74. A curved groove 86 is located near or at an envelope top 84 of each third display envelope 70. The curved groove 86 preferably comprises a channel or an incision having a check-mark shape.

The third suspension means 71 may comprise a thread, fishing line, polymer line, plastic line, filament line, wire, rope, twine, string, yarn, chain, or the like. The third suspension means 71 is fed through the support apertures 92 of the third modular support 68. The third suspension means 71 is routed or laced through the curved groove 86 to couple the third display envelope 70 to the third modular support 68. The third suspension means 71 may be tied into various knots, for example, slip knots, figure-eight knots, clove hitch knots, hitch knots, square knots, or the like. The knots are aligned to secure the third modular support 68 to the third display envelopes 70.

Referring to FIG. 1, FIG. 4, and FIG. 7, a third hanger 72 42 and a third modular support 68 have many of the same illustrated features as those of the first and second hangers 60 and 66 and those of the first and second modular supports 56 and 62 respectively and are alternatively indicated therein. More particularly, the third hanger 42 engages the support cross section 94 of the third modular support 68. The third hanger 42 has a main segment 106, an upper segment 108, and a lower segment 110. The main segment 106 has an longitudinal passageway 104 therethrough with a cross section which substantially conforms to the support cross section 94 of the third modular support 68. A clearance between the passageway 104 and the support cross section 94 of the third modular support 68 permits the third hanger 42 to be slid along the length of the third modular support 68 to balance the third modular assembly 16.

Intermediate Support

Figure 5:
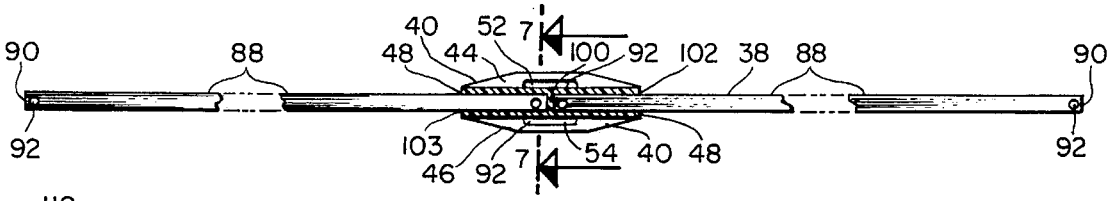
FIG. 5 is an elevation view of the intermediate support, which preferably comprises two modular supports joined by a coupler; the coupler is cut away to reveal a longitudinal cross section of the coupler.

The intermediate support 38 preferably comprises two modular supports 88 placed end to end and joined at a coupler 40 as best illustrated in FIG. 5. The coupler 40 resembles the third hanger 42 except that the coupler's length is preferably longer than the hanger's 42 length. In addition, the coupler 40 preferably has an internal barrier 100 which keeps one modular support 88 placed in the coupler 40 from contacting the other modular support 88 placed in the coupler 40. The intermediate support 38 provides support for suspension of the second modular assembly 14 and the third modular assembly 16 as described subsequently in this specification.

The coupler 40 may include coupler balancing means for balancing the second modular assembly and the third modular assembly. The coupler balancing means comprises, for example, an elongation of the upper member 44 to permit the longitudinal orientation of the primary suspension media 32 to be changed.

Primary Suspension Medium and Secondary Suspension Medium

Referring to FIG. 1, the primary suspension medium 32 and the secondary suspension medium 34 are referred to collectively as the suspension media. The suspension media comprises a plastic line, filament line, fishing line, rope, twine, thread, wire, string, yarn, or chain used to couple or suspend the modular supports 88 or the modular assemblies to the mobile. The suspension media are coupled to the modular supports 88 either directly through the support apertures 92, indirectly via one of the first, second, or third hanger, e.g., third hanger 42, or indirectly via one of the couplers, such as coupler.

Arm Assembly

Figure 6:
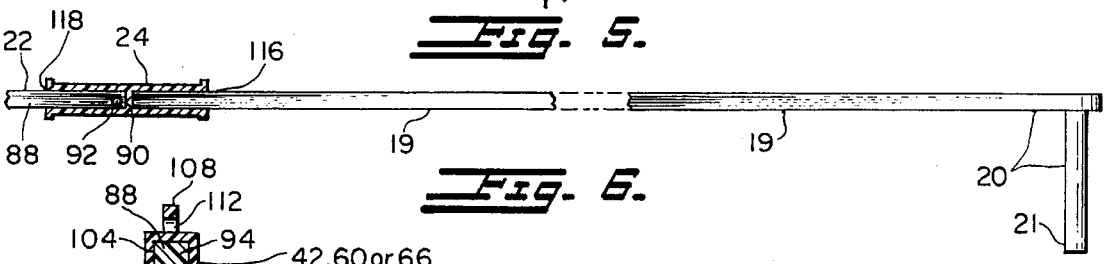
FIG. 6 is an elevation view of the arm assembly, wherein the union is cut away to reveal a longitudinal cross section of the union.

Referring to FIG. 1 and FIG. 6, the first modular assembly 12 is optionally suspended from an arm assembly 10. The arm assembly 10 comprises a bracket 18, a pivot arm 20, a union 24, and an extension arm 22. The pivot arm 20 engages a pivot hole 30 in the bracket 18. The pivot arm 20 is extended by the addition of an extension arm 22. The pivot arm 20 is coupled to the extension arm 22 through the union 24.

The bracket 18 has a bracket holes through which fasteners 26 are extended to fasten the bracket 18 to an external structure, such as a wall. A cylindrical protrusion 28 extends from the bracket 18. The cylindrical protrusion 28 has a pivot hole 30 which is disposed coaxially with respect to an axis of the cylindrical protrusion 28.

The pivot arm 20 has a beam segment 19 and a cylindrical pivot 21. The cylindrical pivot 21 coaxially engages the pivot hole 30. The cylindrical pivot 21 preferably extends orthogonally from the beam segment 19. The cylindrical pivot 21 may comprise a pin or a bar, which is either rigidly or operably attached to the beam segment 19. The pivot arm 20 may rotate with respect to the bracket 18. The beam segment 19 engages a union 24 near or at one end of the beam segment 19.

The union 24 has a first recess 116 and a second recess 118. The beam segment 19 engages the first recess 116. The first recess 116 surrounds a beam cross section of the beam segment 19. The second recess 118 engages the extension arm 22.

The extension arm 22 preferably comprises a modular support 88. The modular support 88 has a support apertures 92 located at one support end 90.

Assembling the Mobile

According to FIG. 1 through FIG. 8, if the mobile includes an arm assembly 10, then the first modular assembly 12 may be suspended from the arm assembly 10 via a primary suspension medium 32. Otherwise, the first modular assembly 12 is suspended from an external structure such as a wall. The first modular assembly 12 is optimally coupled to the arm assembly 10 via the first hanger 60. The first hanger 60 is positioned longitudinally along the first modular support 56 to balance the first modular assembly 12. Additionally, the primary suspension medium 32 may be oriented on the upper segment 108 of first hanger 60 to balance the first modular assembly 12. The intermediate support 38 is coupled to the first modular assembly 12 via a primary suspension medium 32 connecting the first hanger 60 to the coupler 40. In particular, the lower segment 110 of the first hanger 60 is optimally connected to the upper member 44 of the coupler 40 by routing the primary suspension medium 32 through the upper opening 52 and the second opening 114.

The second modular assembly 14 and the third modular assembly 16 are coupled to the intermediate support 38 via the secondary suspension medium 34. In particular, the secondary suspension medium 34 is preferably routed through a support aperture 92 in the intermediate support 38 and the upper segment 108 of the second hanger 66. Similarly, the secondary suspension medium 34 is routed through a support aperture 92 in the intermediate support 38 and the upper segment 108 of the third hanger 42.

The first modular assembly 12, the second modular assembly 14, and the third modular assembly 16 include arrangements of the following modular components: display envelopes (i.e. first display envelopes, second display envelopes, and third display envelopes), modular supports (i.e. first modular support, second modular support and third modular support), and hangers (i.e. first hanger, second hanger, and the third hanger). The following portions of the specification describe the modular components in FIG. 2 through FIG. 8 in greater detail.

Display Envelopes

FIG. 2 shows a view of the front frame 74 of the display envelopes 58, 64 and 70. FIG. 3 shows a cross sectional view of the display envelopes 58, 64 and 70 along reference line 3—3 of FIG. 2. Each of the display envelopes 58, 64 and 70 preferably has a front frame 74, a rear frame 76, a front window 78, and a rear window 80. In the context of the preferred embodiment depicted in FIG. 1, the display envelope 73 refers to the first display envelope 58, the second display envelope 64, or the third display envelope 70.

The front frame 74 has a substantially equilateral (i.e. rectangular) form which may deviate from a perfectly equilateral form by adding decorative enhancements 75 as illustrated in FIG. 2. The front frame 74 provides a border for enclosing an artwork, a photograph, or a picture 96. The rear frame 76 is substantially similar to the front frame 74. The rear frame 76 has a substantially equilateral form which may deviate from a perfectly equilateral form by adding decorative enhancements similar to those shown in FIG. 2. The front frame 74 is hinged, or flexibly attached, to the rear frame 76. Optimally, the front frame 74 and the rear frame 76 are hinged near an envelope bottom 85.

A curved groove 86 is preferably located at an envelope top 84 of each of the display envelopes 58, 64 and 70. The curved groove 86 may comprise a channel or an incision extending into each of the display envelopes 58, 64 and 70. The curved groove 86 preferably is shaped like a check mark as best illustrated in FIG. 2. The curved groove 86 has a size which permits the routing of the first suspension means 61, the second suspension means 69, or the third suspension means 71 through the curved groove 86. In other words, the curved groove 86 has a size which permits the routing of a thread, a filament line, a plastic line, a polymer line, a string, a wire, a cable, or the like of a predetermined size through the curved groove 86.

In an alternative embodiment, envelope apertures are located at an envelope top of the rear frame 76 and the front frame 74. The envelope apertures optimally receive a suspension medium, a binder, or a retainer to secure the front frame 74 to the rear frame 76 such that the pictures 96 or the artwork is retained in either of the display envelopes 58, 64 and 70.

The front window 78 and the rear window 80 have window areas. For instance, if the front window 78 had an entirely rectangular shape, the window area would merely be the area resulting from multiplying the height by the width of the rectangular shape. The window areas are preferably equal to or smaller than the areas of standard commercially available rectangular photographs. For example, standard commercially available photographs presently include various rectangular sizes, such as two and one-half inches by three and one-half inches, three and one-half inches by three and one-half inches, three and one-half inches by five inches, and five inches by seven inches. Two photographs, artwork, or pictures are optimally placed in a back to back relationship with respect to one another so that each of the envelopes 58, 64 and 70 display may simultaneously display a photograph in the front window 78 and the rear window 80.

Modular Supports

Referring to FIG. 1, FIG. 4, FIG. 5, FIG. 7 and FIG. 8, the modular supports 88 have a support cross section 94, support ends 90, and support apertures 92. In addition, two modular supports 88 are used to make the intermediate support 38. Each modular support 88 optimally has approximately the same shape and size as all other modular supports 88. The modular support 88 is preferably approximately ten inches long. The modular 88 support has two support ends 90. A support mounting aperture 92 is located near or at each support end 90. As shown in FIG. 4 and FIG. 5, all of the support apertures 92 optimally have parallel axes. In alternative embodiments, the support apertures 92 may be replaced by notches on the surface of the modular support 88. As best illustrated in FIG. 7 the support cross section 94 of the modular support 88 is substantially rectangular. Alternatively, the support cross section 94 may be circular, elliptical, or shaped in other ways.

The modular support 88 is preferably constructed from a plastic, a polymer, a resin, or the like. For example, the support may be constructed from polyester, epoxy, thermoset plastic, thermoplastic, or the like. In addition, the plastic, polymer, or resin may be reinforced by reinforcing materials, such as glass fiber, carbon fiber and graphite fiber. The modular 88 support may be formed by an extrusion process with a rectangular die opening. The extruded material is then cut to the appropriate length and the support apertures 92 are bored.

Hanger

The hangers 42, 60 and 66 are illustrated in FIG, 4 and FIG. 7. The hangers 42, for example, comprises an upper segment 108, a main segment 106, and lower segment 110. The upper segment 108 and the lower segment 110 are attached to the main segment 106. A first opening 112 is defined by the intersection of the upper segment 108 with main segment 106 and a second opening 114 is defined by the intersection of the lower segment 110 with the main segment 106. As illustrated in FIG. 4, the upper segment 108 and the lower segment 110 have a trapezoidal shapes. In alternate embodiments, the upper segment 108 and the lower segment 110 may have arched shapes, pyramidal shapes, equilateral shapes, triangular shapes, or the like.

The mobile may include balancing means for balancing mobile components. The balancing means includes one or more of the following (a) an elongation of the upper segment 108 or the lower segment 110 to permit longitudinal adjustment of the primary suspension medium 32 or the secondary suspension medium 34 associated with the hanger 42; (b) a clearance between the passageway 104 and the modular support 88 sufficient to permit the hanger 42 to slide longitudinally along the modular support 88 for adjustment; (c) shaping the lower segment 110 to contain or comprise an arch or a dip for centering the primary suspension medium 32 by the application of weight or tension upon primary suspension medium 32;. and (d) shaping the upper segment 108 to contain or comprise an arch or a peak for centering the primary suspension medium 32 or the secondary suspension media 34 by the application of weight or tension upon the suspension media.

Alternative Embodiments of Modular Components

Figure 9:
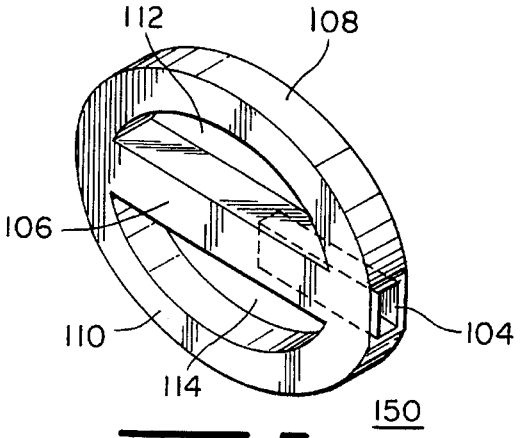
FIG. 9 is a perspective view of an alternate embodiment of the hanger, wherein the upper segment and the lower segment are arched.
Figure 10:
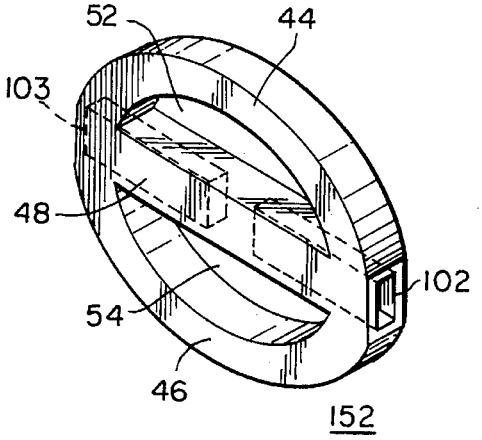
FIG. 10 is a perspective view of an alternate embodiment of the coupler, wherein the upper member and the lower member are arched.
Figure 11:
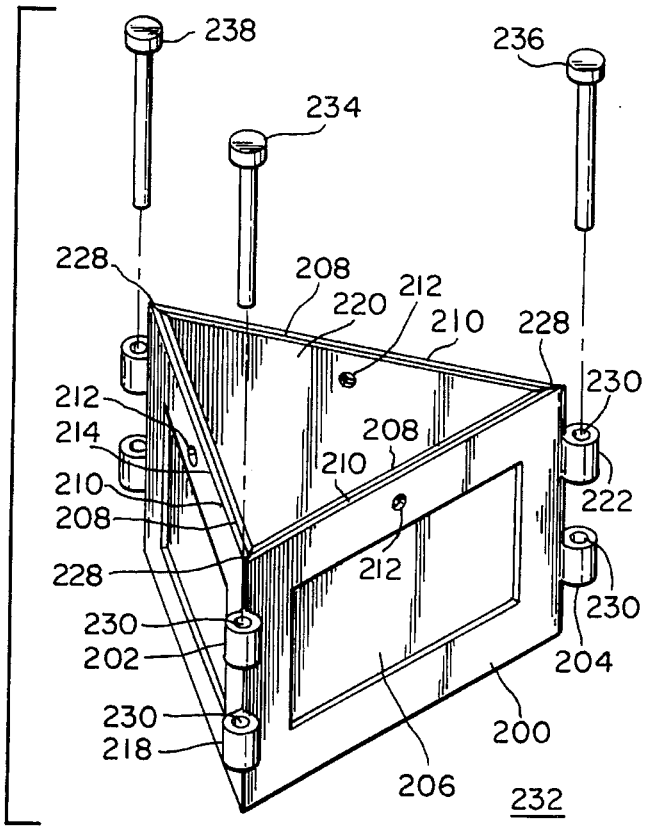
FIG. 11 is a perspective view of an alternative embodiment of the display envelope, wherein alternate display envelopes (i.e. alpha display envelope) are joined to each other at their sides to form a three-dimensional envelope assembly.

FIG. 9 through FIG. 11 show various alternative embodiments of the modular components. FIG. 9 shows an alternate embodiment of the hanger, which is labeled alternate hanger 150 and is indicated with many of the reference numbers of FIG. 7. In the alternate hanger 150, the upper segment 108 and the lower segment 110 have arched shapes. The hanger 150 has its main segment 106 with its passageway 114 therein. The arched shapes tend to center the primary suspension medium 32 or the secondary suspension medium 34 by tension or by the weight applied to the primary suspension medium 32 or the secondary suspension medium 34.

Figure 8:
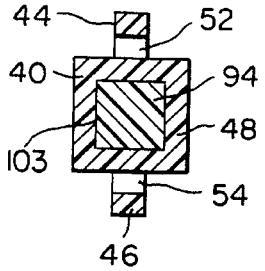
FIG. 8 is a transverse cross sectional view of the coupler as viewed along reference line 8—8 of FIG. 5.

FIG. 10 shows an alternate embodiment of the coupler such as coupler 40 of FIG. 8, which is designated as the alternate coupler 152. The alternate coupler 152 has an upper member 44 and a lower member 46 that are arched. A first socket 102 and a second socket 103 are rectangular so as to engage the support ends 90 and the support cross section 94 of the modular supports 88. The support apertures may engage nibs located in the alternate coupler 152 to retain the modular supports and a portion of the support cross section of the modular supports.

FIG. 11 shows an alternate embodiment of the display envelopes arranged into a three-dimensional envelope assembly 232. The display envelope assembly 232 includes alternate display envelopes, namely, an alpha envelope 200, a beta envelope 214, and a delta envelope 220. The alpha envelope 200 has a first mount 202 and a second mount 204. The first mount 202 and the second mount 204 both have bores 230. The beta envelope 214 has a third mount (not shown) and a fourth mount 218 with bores 230. The delta envelope 220 has a fifth mount 222 and a sixth mount (not shown) with bores 230. The bores 230 of the first mount 202 and the fourth mount 218 are axially aligned; a first fastener 234 is placed in the bores 230 to join the alpha envelope 200 and the beta envelope 214. The bores 230 of the second mount 204 and the fifth mount 222 are axially aligned; a second fastener 236 is placed in the bores 230 to join the alpha envelope 200 and the delta envelope 220. The bores 230 of the third mount and the sixth mount are joined by a third fastener 238. The first fastener 234, the second fastener 236, and the third fastener 238, each comprise, for example, a pin, a stud, a rod, a bolt, a clip, a rivet, or the like. One or more of the bores 230 have threads corresponding optional fastener threads.

The alpha envelope 200, the beta envelope 214, and the delta envelope 220 each preferably have tapered edges 228 to facilitate the combination of said alternate display envelopes into the envelope assembly 232. The alpha envelope 200, the beta envelope 214, and the delta envelope 220 each have a front portion 210, a back portion 208, and a window 206 for displaying pictures, photographs, or artwork. The front portion 210 is preferably coupled to the back portion 208 at the bottom of each alternate display envelope. A gap or slit exists at the top of each of the alternate display envelopes for introducing a substantially flat picture into each of the alternate display envelopes. Holes 212 are provided near or at the top of the alpha envelope 200, the beta envelope 214, and the delta envelope 220. A suspension media may be laced through the holes 212 to hang the envelope assembly 232 from a modular support. Alternatively, a groove or a channel may be placed in each envelope in lieu of the holes 212.

The foregoing description is provided in sufficient detail to enable one of ordinary skill in the art to make and use the mobile of the present invention. The foregoing detailed description is merely illustrative of one or more physical embodiments of the mobile. Physical variations of the mobile of the present invention, not fully described in the specification, may be encompassed within the purview of the following claims. Accordingly, the narrow description of the elements in the specification should be used for general guidance, rather than to unduly restrict the broader descriptions of the elements in the following claims.

What is claimed is:

1. A mobile for displaying artwork, including pictures, the mobile comprising:

a modular support having a support cross section;

a hanger having a passageway therethrough, a portion of the support cross section being received in said passageway, said hanger having an upper segment, a lower segment, and a main segment, the upper segment and the lower segment being attached to the main segment, a first opening defined by an intersection of the upper segment with the main segment and a second opening defined by the intersection of the lower segment with the main segment, and a passageway disposed in the main segment;

a plurality of display envelopes, each display envelope having a front frame with a front window;

suspension means for suspending one of said display envelopes, said suspension means connecting said one of said display envelopes to the modular support; and a primary suspension means the primary suspension means being coupled to said hanger.

2. The mobile according to claim 1 wherein each one of the upper segment and the lower segment has a shape selected from the group consisting of a substantially arched shape and a substantially trapezoidal shape.

3. The mobile according to claim 1 wherein said primary suspension medium is routed through an opening selected from the group consisting of the first opening and the second opening.

4. A mobile for displaying artwork, including pictures, the mobile comprising:

a modular support having a support cross section;

a hanger having a passageway therethrough, a portion of the support cross section being received in said passageway;

a plurality of display envelopes, each display envelope having a front frame with a front window;

suspension means for suspending one of said display envelopes, said suspension means connecting said one of said display envelopes to the modular support;

a primary suspension means, the primary suspension means being coupled to the hanger and;

balancing means for slidably balancing modular components; wherein the balanced modular components include the modular support and the plurality of display envelopes, said balancing means comprising said hanger having an upper segment slidably attached to a main segment and wherein the upper segment has means for being releasably attached to said primary suspension means and is elongated to permit adjustment of a longitudinal orientation of said primary suspension means.

5. A mobile for displaying artwork, including pictures, the mobile comprising:

a modular support having a support cross section;

a hanger having a passageway therethrough, a portion of the support cross section being received in said passageway;

a plurality of display envelopes, each display envelope having a front frame with a front window;

suspension means for suspending one of said display envelopes, said suspension means connecting said one of said display envelopes to the modular support;

a primary suspension means, the primary suspension means being coupled to the hanger; and balancing means for slidably balancing modular components; wherein the balanced modular components include the modular support and the plurality of display envelopes, said balancing means comprising said hanger having a lower segment slidably attached to a main segment and wherein the lower segment has means for being releasably attached to said primary suspension means and is elongated to permit slidable adjustment of a longitudinal orientation of the primary suspension means.

6. A mobile for displaying pictures, the mobile comprising:

a first modular assembly, the first modular assembly having a first modular support and first display envelopes, the first display envelopes being suspended from the first modular support;

a second modular assembly, the second modular assembly having a second modular support and second display envelopes, the second display envelopes being suspended from the second modular support;

a third modular assembly, the third modular assembly having a third modular support and third display envelopes, the third display envelopes being suspended from the third modular support;

an intermediate support including a coupler, the coupler having an upper member, a main body, and a lower member, the upper member and the lower member being attached to the main body, an intersection of the lower member with the main body forming a lower opening; and suspension means for connecting the intermediate support to the first modular assembly and for connecting the second modular assembly and third modular assembly to the intermediate support.

7. A mobile for displaying pictures, the mobile comprising:

a first modular assembly, the first modular assembly having a first modular support and first display envelopes, the first display envelopes being suspended from the first modular support;

a second modular assembly, the second modular assembly having a second modular support and second display envelopes, the second display envelopes being suspended from the second modular support;

a third modular assembly, the third modular assembly having a third modular support and third display envelopes, the third display envelopes being suspended from the third modular support;

an intermediate support;

suspension means for connecting the intermediate support to the first modular assembly and for connecting the second modular assembly and third modular assembly to the intermediate support; and a first hanger, a second hanger, and a third hanger, the first hanger having a first passageway that engages a portion of a support cross section of the first modular support, a second hanger having a second passageway that engages a portion of a support cross section of the second modular support, and a third hanger having a third passageway that engages a portion of a support cross section of the third modular support, wherein each of the first, second, and third hangers has a main segment, an upper segment, and a lower segment, the upper segment and the lower segment being attached to the main segment, the intersection of the upper segment and the main segment defining a first opening, the intersection of the lower segment and the main segment defining a second opening, each of the main segments having a passageway.

8. A mobile for display pictures, the mobile comprising:

a first modular assembly, the first modular assembly having a first modular support and first display envelopes, the first display envelopes being suspended from the first modular support;

a second modular assembly, the second modular assembly having a second modular support and second display envelopes, the second display envelopes being suspended from the second modular support;

a third modular assembly, the third modular assembly having a third modular support and third display envelopes, the third display envelopes being suspended from the third modular support;

an intermediate support including a coupler having an upper member and further comprising coupler balancing means for slidably balancing the second modular assembly and the third modular assembly, said coupler balancing means including an elongation of said upper member to permit a slidable adjustment of the orientation of the suspension means; and suspension means for connecting the intermediate support to the first modular assembly and for connecting the second modular assembly and third modular assembly to the intermediate support.

* * * * *